US005398582A

United States Patent [19]

Smith

[11] Patent Number: 5,398,582

[45] Date of Patent: Mar. 21, 1995

[54] WIRE CLAMPING LIGATURE FOR USE WITH A SINGLE REED MOUTHPIECE FOR A MUSICAL INSTRUMENT

[75] Inventor: Gary T. Smith, 256 W. 5th Ave., Collegeville, Pa. 19426

[73] Assignees: Mobile Music Inc., Horsham; Gary Smith, Collegeville; Joseph Stefano, Oreland, all of Pa.

[21] Appl. No.: 41,362

[22] Filed: Apr. 1, 1993

[51] Int. Cl.[6] ..... G10D 9/02

[52] U.S. Cl. ..... 84/383 R

[58] Field of Search ..... 84/383 R, 383 A, 380, 84/382, 385 R, 453

[56] References Cited

U.S. PATENT DOCUMENTS

| | | | |
|---|---|---|---|
| 555,561 | 3/1896 | Cadwallader | 84/383 R |
| 4,185,535 | 1/1980 | Lorenzini | 84/383 R |
| 4,258,604 | 3/1981 | Giokas | 84/383 R |
| 5,289,752 | 3/1994 | Barbaglia | 84/383 R |

*Primary Examiner*—Michael L. Gellner
*Assistant Examiner*—Cassandra C. Spyrou
*Attorney, Agent, or Firm*—Sperry, Zoda & Kane

[57] ABSTRACT

A wire clamping ligature for use with single reed musical instruments such as clarinets and saxophones which includes two retaining wires extending circumferentially around the mouthpiece and reed of the instrument to affix the reed to the mouthpiece and yet allow normal musical vibration thereof wherein the retaining wires are approximately thirty thousandths of an inch (0.030 inches) and including two drawbars each attached to the opposite ends of the two retaining wires with an adjustable clamp secured therebetween. The adjustable clamp can comprise one or two threaded screws rotatably mounted in one drawbar and threadedly engaged with respect to the other drawbar to urge the drawbars together for tightening of the two retaining wires about the reed and mouthpiece for detachably affixing them together.

21 Claims, 3 Drawing Sheets

WIRE CLAMPING LIGATURE FOR USE WITH A SINGLE REED MOUTHPIECE FOR A MUSICAL INSTRUMENT

BACKGROUND OF THE INVENTION

1. Field of the Invention

The present invention pertains to the general field of ligatures which are clamping devices utilized for holding of a reed in place with respect to a clarinet or saxophone and in particular with respect to the clarinet or saxophone mouthpiece. Prior art ligatures utilize wide bands for securing of the reed at one or more locations with respect to the mouthpiece. It has been found that these wide ligatures tend to restrict the vibrational characteristics of the reed which is extremely important when utilized with such woodwind instruments.

Within the field of art of the present invention there were are many ligature designs which hold a reed firmly to the mouthpiece. However, a need has arisen for the use of a reed retaining ligature which provides additional freedom of movement of the reed to vibrate during operation of the woodwind musical instrument with as little dampening as possible in order to render a full rich sound.

2. Description of the Prior Art

Many designs have been patented for providing a ligature for woodwind instruments such as U.S. Pat. No. 555,561 issued Mar. 3, 1896 to G. R. Cadwallader on a "Reed Supporter For Clarinets"; and U.S. Pat. No. 1,496,535 issued Jun. 3, 1924 to F. B. Hammann on a "Toy"; and U.S. Pat. No. 1,535,537 issued Apr. 28, 1925 to W. Majeski on an "Adjustable Reed In Wind Instruments"; and U.S. Pat. No. 1,615,549 issued Jan. 25, 1927 to B. Miller on a "Mouthpiece For Reed Instruments"; and U.S. Pat. No. 1,896,814 issued Feb. 7, 1933 to W. Gemeinhardt on a "Mouthpiece Of Wind Musical Instruments"; and U.S. Pat. No. 2,193,976 issued Mar. 19, 1940 to C. B. Malbon on an "Adjustable Reed For Wind Instruments"; and U.S. Pat. No. 2,318,515 issued May 4, 1943 to J. C. Nemcek, Jr. on a "Reed"; and U.S. Pat. No. 2,648,246 issued Aug. 11, 1953 to W. W. Mueller on a "Ligature For Musical Instruments"; and U.S. Pat. No. 2,669,897 issued Feb. 23, 1954 to J. Topor on a "Reed For Musical Instruments"; and U.S. Pat. No. 2,837,003 issued Jun. 3, 1958 to J. Collis on a "Mouthpiece And Ligature For Reed Instruments"; and U.S. Pat. No. 3,250,753 issued Sep. 14, 1965 to R. L. Luyben on a "Ligature For Reed Instruments"; and U.S. Pat. No. 3,433,113 issued Mar. 18, 1969 to B. A Portnoy on "Ligatures Or Reed Holders For Single-Reed Musical Wind Instruments"; and U.S. Pat. No. 3,564,965 issued Feb. 23, 1971 to J. Carlini et al on a "Ligature For Reed Musical Instrument"; and U.S. Pat. No. 3,890,873 issued Jun. 24, 1975 to R. Harrison on a "Ligature"; and U.S. Pat. No. 4,056,997 issued Nov. 8, 1977 to P. Rovner on a "Reed Holding Device For Musical Instruments"; and U.S. Pat. No. 4,080,866 issued Mar. 28, 1978 to M. Toof on a "Ligature Means And A Method Of Securing A Reed In A Wind Instrument"; and U.S. Pat. No. 4,172,482 issued Oct. 30, 1979 to H. Gomez on a "Method And Apparatus For Adjusting Single Reeds For Musical Instruments"; and U.S. Pat. No. 4,185,535 issued Jan. 29, 1980 to R. Lorenzini on a "Reed-Holding Device"; and U.S. Pat. No. 4,210,055 issued Jul. 1, 1980 to V. Platamone, Jr. on an "Adjustable Ligature For Musical Instrument"; and U.S. Pat. No. 4,258,604 issued Mar. 31, 1981 to D. Giokas on a "Ligature"; and U.S. Pat. No. 4,275,636 issued Jun. 30, 1981 to B. Van Doren on "Ties For The Mouthpiece Of A Wind Instrument"; and U.S. Pat. No. 4,296,668 issued Oct. 27, 1981 to R. Lorenzini on a "Reed Protector For A Woodwind Instrument"; and U.S. Pat. No. 4,347,776 issued Sep. 7, 1982 to K. Grass et al on an "O-Ring Ligature"; and U.S. Pat. No. 277,967 issued Mar. 12, 1985 to G. Gholson, Jr. on a "Clarinet Ligature"; and U.S. Pat. No. 4,615,616 issued Oct. 7, 1986 to Y. Shiomi on a "Measuring Distance Apparatus"; and U.S. Pat. No. 4,669,352 issued Jun. 2, 1987 to S. Bichon on a "Tying Device For The Mouth Piece Of A Wind Instrument"; and U.S. Pat. No. 4,796,507 issued Jan. 10, 1989 to T. Stibai on a "Reed Holding Device"; and U.S. Pat. No. 4,941,385 issued Jul. 17, 1990 to C. Johnson on a "Tone Plate And Clamping Device For A Musical Instrument Mouthpiece"; and U.S. Pat. No. 4,991,483 issued Feb. 12, 1991 to R. Petit on a "Mouthpiece For Wind Instrument, And Corresponding Ligature And Mouthpiece Cover"; and U.S. Pat. No. 5,000,073 issued Mar. 19, 1991 to D. Hite on a "Construction For Supporting A Reed Upon The Mouthpiece Of A Musical Wind Instrument And Method Of Fabricating The Same"; and U.S. Pat. No. 5,018,425 issued May 28, 1991 to P. Rovner on a "Mouthpiece System For Woodwind Instruments"; and U.S. Pat. No. 5,033,350 issued Jul. 23, 1991 to A. Galper on a "Single Reed Mouthpiece"; and U.S. Pat. No. 5,105,701 issued Apr. 21, 1992 to J. Hall et al on a "Clarinet Mouthpiece".

SUMMARY OF THE INVENTION

The present invention provides a wire clamping ligature for use with a single reed mouthpiece for a musical instrument which includes a first reed retaining wire extending around the instrument mouthpiece and an adjacently positioned reed for retaining thereof together while allowing full musical vibrational movement of the reed. This first reed retaining wire is preferably of a diameter of less than 0.100 inches and is preferably approximately 0.030 inches in diameter. The first reed retaining wire defines a first end and a first reed second end thereon.

A similarly configured second reed retaining wire extends about the mouthpiece and the adjacently positioned reed at a position spatially disposed longitudinally along the reed from the location of the first reed retaining wire. In this manner the combination of the first reed retaining wire and the second reed retaining wire will retain the reed in adjacent abutment to the mouthpiece and yet still allow full normal musical vibrational movement thereof. The second reed retaining wire also is preferably of a diameter less than 0.100 inches and is preferably configured at approximately 0.030 inches in diameter. The second reed retaining wire also includes a second reed first end and a second reed second end defined thereon.

A first drawbar is included attached to the first reed first end of the first reed retaining wire and attached to the second reed first end of the second reed retaining wire to facilitate retaining of the reed in engagement with respect to the mouthpiece. Similarly a second drawbar is attached with respect to the first reed second end of the first reed retaining wire and is also attached with respect to the second reed second end of the second reed retaining wire to facilitate retaining of the reed in abutment with the mouthpiece and yet allow vibrational movement thereof for full tonal qualities of the woodwind musical instrument.

An adjustable clamping device is operatively secured to the first drawbar and the second drawbar and is adapted to urge the first drawbar and the second drawbar together for tightening of the first reed retaining wire and the second reed retaining wire about the reed to affix it into abutment with respect to the mouthpiece of the instrument while still allowing musical vibrational movement thereof. The first and second reed retaining wires are preferably formed of a stainless steel wire material.

The adjustable clamping means of the present invention can include the combination of a threaded bore defined within the second drawbar and a clearance bore defined within the first drawbar. The threaded bore in the second drawbar is itself threaded whereas the clearance bore in the first drawbar is not threaded. A threaded clamping screw is adapted to extend through the clearance bore to be freely rotatable therein and to further extend into engagement with respect to the threaded bore to facilitate adjustable clamping movement in the first drawbar and the second drawbar. Tightening of the threaded clamping screw will pull the threaded bore and the second drawbar toward the clearance bore and the first drawbar. A cap means may be positioned on the threaded clamping screw adjacent the clearance bore to facilitate retainment of the clamping screw therein. The threaded bore is preferably positioned on the second drawbar between the points of attachment of the first reed retaining wire and the second reed retaining wire thereto. Similarly the clearance bore is preferably defined in the first drawbar at a position between the location of the first reed retaining wire and the second reed retaining wire. As such, tightening of the threaded clamping screw will automatically equalize the pressure exerted by the first reed retaining wire and the second reed retaining wire with respect to one another due to the tightening thereof being exerted at a point between the positions of attachment thereto. To further facilitate tightening of the threaded clamping screw, a thumb screw tab may be fixedly secured thereto to facilitate rotational movement thereof.

In an alternative configuration of the adjustable clamping device of the present invention two clamping screws may be included adapted to extend through two pairs of clearance bores and threaded bores defined within bosses defined on the first and second drawbars respectively. Each individual threaded clamping screw will be of a configuration similar to the screw utilized in the above described configuration utilizing a single such screw and each may include cap means and thumb screw means to facilitate securement.

It is an object of the present invention to provide a wire clamping ligature for use with a single reed mouthpiece for a musical instrument wherein full vibrational movement of the reed is allowed.

It is an object of the present invention to provide a wire clamping ligature for use with a single reed mouthpiece for a musical instrument wherein the reed can be held firmly while still allowing it the freedom to vibrate naturally.

It is an object of the present invention to provide a wire clamping ligature for use with a single reed mouthpiece for a musical instrument wherein damping of the musical vibrational movement of the reed is minimized to allow for a full rich sound as the instrument is played.

It is an object of the present invention to provide a wire clamping ligature for use with a single reed mouthpiece for a musical instrument wherein removal and replacement of the reed is made simple and easy.

It is an object of the present invention to provide a wire clamping ligature for use with a single reed mouthpiece for a musical instrument wherein costs of the equipment is minimized.

It is an object of the present invention to provide a wire clamping ligature for use with a single reed mouthpiece for a musical instrument wherein reliability and efficiency of operation is enhanced.

It is an object of the present invention to provide a wire clamping ligature for use with a single reed mouthpiece for a musical instrument wherein down time is minimized.

It is an object of the present invention to provide a wire clamping ligature for use with a single reed mouthpiece for a musical instrument wherein conventional high tensile steel music wire can be utilized for clamping of the reed.

It is an object of the present invention to provide a wire clamping ligature for use with a single reed mouthpiece for a musical instrument wherein attachment or detachment with respect to the mouthpiece and reed configuration is extremely easy and quick.

It is an object of the present invention to provide a wire clamping ligature for use with a single reed mouthpiece for a musical instrument wherein usage with various types of instruments is possible such as B flat Clarinet, E flat Clarinet, Soprano, Alto, Tenor and Baritone Saxophones, etc.

It is an object of the present invention to provide a wire clamping ligature for use with a single reed mouthpiece for a musical instrument wherein usage with existing reed and mouthpiece equipment of woodwind instruments is significantly enhanced.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
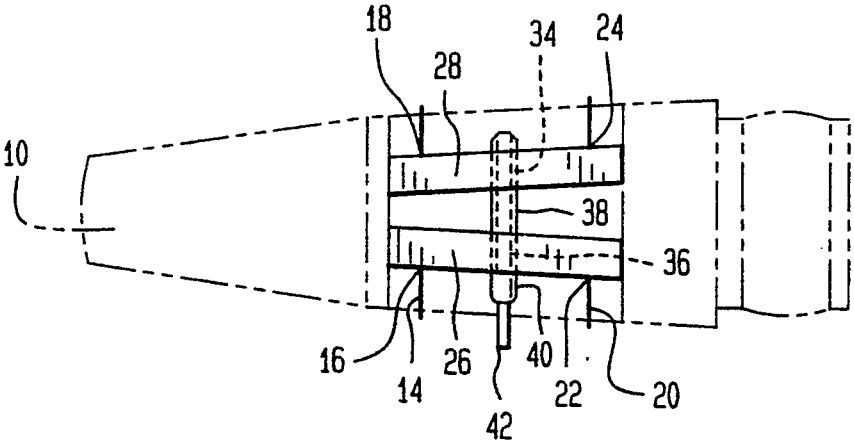
FIG. 1 is a top plan view of an embodiment of the wire clamping ligature of the present invention shown in use with a single reed mouthpiece for a musical instrument.

The present invention provides a wire clamping ligature for use securing of a reed 12 with respect to a mouthpiece 10 of a conventional woodwind instrument such as one of various types of clarinets or saxophones. The ligature of the present invention includes a first reed retaining wire 14 adapted to extend circumferentially about the mouthpiece 10 to clamp the reed 12 in position thereagainst. The first reed retaining wire 14 includes a first end 16 and a second end 18 thereof adapted to wrap around the mouthpiece 10.

In a similar configuration the second reed retaining wire 20 is adapted to extend about the mouthpiece 10 to retain the reed 12 in abutment therewith. The second reed retaining wire 20 is spatially positioned longitudinally along the reed 12 from the point of securement of the first reed retaining wire 14 to further affix the reed 12 with respect to the mouthpiece 10. The second reed retaining wire 20 includes a first end 22 and a second end 24 thereof.

The first end 16 of the first reed retaining wire 14 and the first end 22 of the second reed retaining wire 20 are secured with respect to a first drawbar 26 to be movable therewith. In a similar fashion the second end 18 of the first reed retaining wire 14 and the second end 24 of the second reed retaining wire 20 are secured with respect to a second drawbar 28. An adjustable clamping means 30 is adapted to tighten the first drawbar 26 and the second drawbar 28 with respect to one another to stretch the retaining wires 14 and 20 around the mouthpiece 10 and in engagement with the reed 12 for fixedly securing them together.

Once the reed 12 is so secured with respect to the mouthpiece 10 it is still preferably that the reed 12 be capable of vibrational movement to achieve the normal musical tonal qualities achieved by such single reed configurations when used with woodwind instruments such as clarinets and saxophones. For this purpose the present invention is designed with the retaining wires 14 and 20 being of a wire diameter less than 0.100 inches and preferably of approximately 0.030 inches. With this size of retaining wire the reed 12 can be fixedly secured with respect to the mouthpiece 10 while still being capable of full vibrational movement to achieve the tonal qualities of the woodwind instrument as desired. The wire diameter is shown as reference numeral 32 in the drawings.

The configuration of the adjustable clamping means 30 can include a threaded bore 34 defined in the second drawbar means 28 between the points of attachment of the first retaining reed wire 14 and the second retaining reed wire 24 with respect thereto. In a similar fashion the clearance bore 36 can be defined in the first drawbar 26 at a position between the points of attachment with respect thereto of the first reed retaining wire 14 and the second reed retaining wire 20. A threaded clamping screw 38 having a cap means 40 therein is adapted to extend through the clearance bore 36. The threaded clamping screw 38 will be of a small enough size to, allow full rotational movement thereof within the clearance bore 36 without engagement with respect to the wall thereof. Once the threaded clamping screw 38 extends fully through the clearance bore 36 such that the cap means 40 thereof is in abutment with respect to the area of the first drawbar 26 adjacent the clearance bore 36 the threaded end of the clamping screw 38 can then engage with respect to the threads defined in the threaded bore 34. Adjacent the cap means 40 of the screw 38 preferably a thumb screw tab 42 will be included to facilitate rotational movement of the threaded clamping screw 38 as desired. Rotation of the threaded clamping screw 38 by gripping and rotation of the thumb screw tab 42 or other means will facilitate drawing of the first drawbar 26 toward the second drawbar 28 in such a manner as to tighten the first reed retaining wire 14 and the second reed retaining wire 20 extending about the mouthpiece 10 and reed 12 combination.

In an alternative configuration the adjustable clamping means 30 can comprise a configuration utilizing a first threaded clamping screw 60 as well as a second threaded clamping screw 62 as shown in the configuration of FIGS. 4, 5, 6 and 7. With these configurations the first drawbar 26 will include a first clearance boss 44 and a second clearance boss 48 thereon. First clearance boss 44 will define a first clearance bore 46 extending therethrough. Similarly, the second clearance bore 50 will define the second clearance boss 48 extending therethrough.

In a similar configuration the second drawbar 28 will include a first engagement boss 52 and a second engagement boss 56 thereon. First engagement boss 52 will define a first threaded bore 54 extending therethrough in axial registration and alignment with respect to the first clearance boss 44. The second engagement boss 56 will define a second threaded bore 58 extending therethrough in axial alignment and registration with respect to the second clearance bore 50.

The first threaded clamping screw 60 will preferably include a first cap means 64 thereon as well as a first thumb screw tab 68. In an analogous configuration the second threaded clamping screw 62 will include a second cap means 66 thereon as well, as a second thumb screw tab 70.

The first threaded clamping screw 60 will be adapted to extend through the first clearance bore 46 and into the first threaded bore 54 for engagement with the threads therein. With this configuration the first cap means 64 will abut the area of the first drawbar 26 surrounding the first clearance boss 44.

In a similar configuration the second threaded clamping screw 62 will be adapted to extend through the second clearance bore 50 with the second cap means 66 thereof in engagement with respect to the first drawbar 26 in the area adjacent the second clearance boss 48 thereof. The second threaded clamping screw 62 will extend further into engagement with respect to the second threaded bore 58 in a similar to the engagement of the first threaded clamping screw 60 with respect to the first threaded bore 54. With this configuration tightening of the first threaded clamping screw 60 and the second threaded clamping screw 62 will achieve tightening of the first drawbar 26 with respect to the second drawbar 28 thereby tightening of the first reed retaining wire 14 and the second reed retaining wire 20 around the mouthpiece 10 and reed 12 combination for fixedly securing them with respect to one another.

In the preferred configuration the first clearance boss 44 will be positioned adjacent the point of securement of the first reed retaining wire 14 with respect to the first drawbar 26. Similarly the second clearance boss 48 will preferably be configured on the first drawbar means 26 adjacent the point of securement thereto of the second reed retaining wire 20.

Furthermore the first engagement boss 52 will preferably be positioned on the second drawbar 28 immediately adjacent the point of securement thereto of the first reed retaining wire 14. Similarly the second engagement boss 56 will preferably be defined on the second drawbar 28 immediately adjacent the point of securement thereto of the second reed retaining wire 20.

Figure 2:
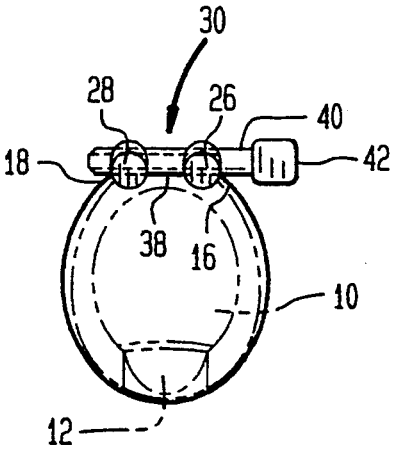
FIG. 2 is an end plan view of the embodiment shown in FIG. 1 as viewed from the left.
Figure 3:
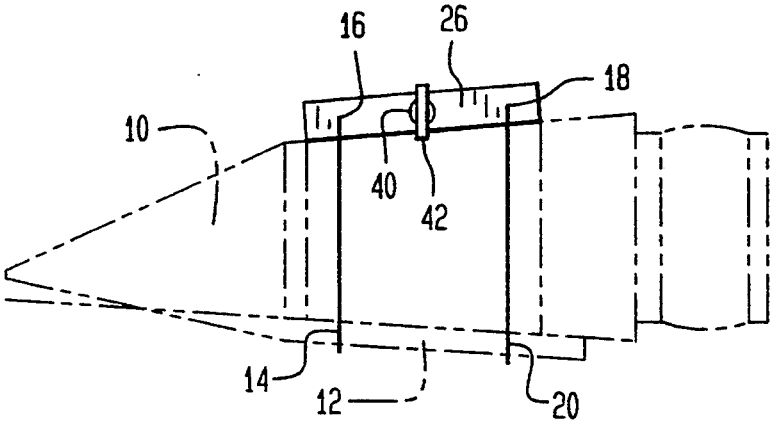
FIG. 3 is a side plan view of the embodiment shown in FIG. 1 as viewed from the bottom.
Figure 4:
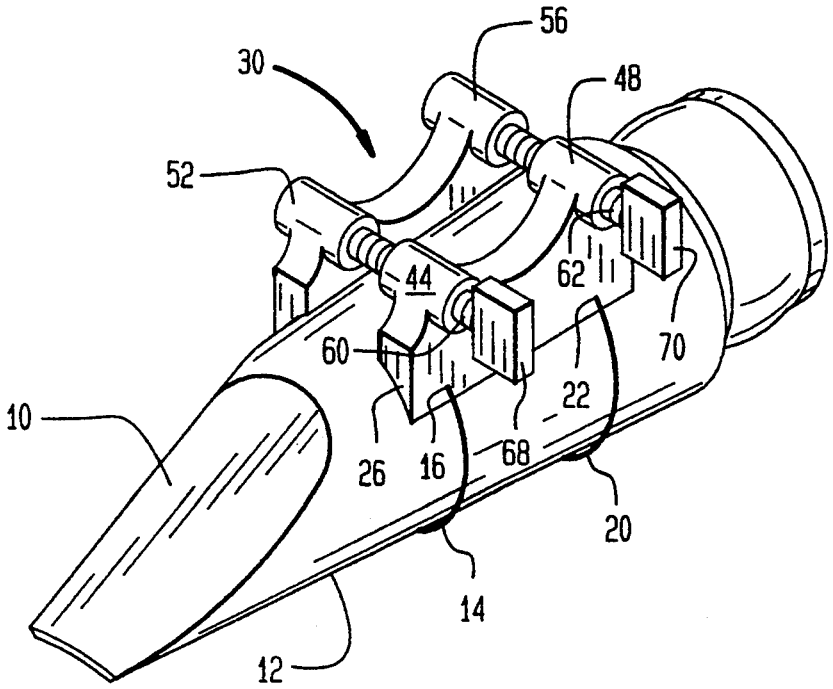
FIG. 4 is a three quarter perspective illustration of an alternative embodiment for the wire clamping ligature of the present invention shown utilizing two clamping screws.
Figure 5:
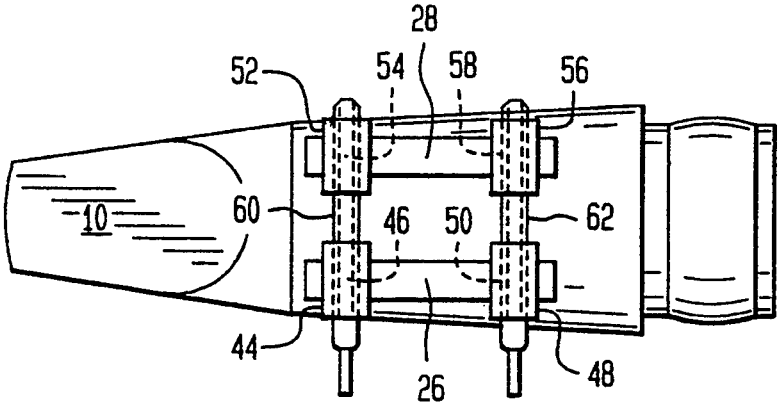
FIG. 5 is a top plan view of the embodiment shown in FIG. 4.
Figure 7:
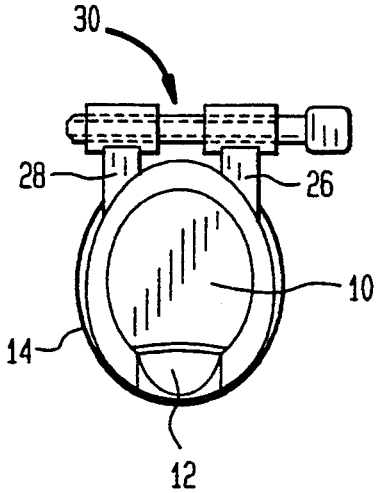
FIG. 7 is an end plan view of the embodiment shown in FIG. 5 as viewed from the left.
Figure 6:
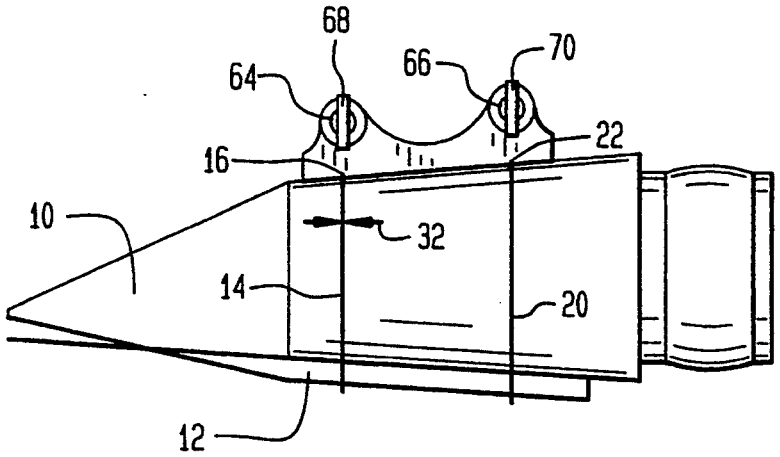
FIG. 6 is a side plan view of the embodiment shown in FIG. 5 as viewed from the bottom.

With the configuration of the present invention utilizing either the double screw clamping configuration of FIGS. 4 through 7 or the single screw clamping configuration of FIGS. 1 through 3 the present invention provides a configuration having two retaining wires each of a dimension of approximately 0.030 inches in diameter for securing of a reed 12 with respect to a mouthpiece 10 in such a manner as to maintain fixed securement therebetween and yet allow full musical vibrational movement of the reed to achieve the full tonal qualities of the woodwind or other musical instrument used therewith.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A wire clamping ligature for use with a single reed mouthpiece for a musical instrument comprising:

A. a first reed retaining wire means extending once around a mouthpiece and an adjacently positioned reed for retaining thereof together while allowing musical vibrational movement of the reed, said first reed retaining wire means being of a metallic material, said first reed retaining wire means having a diameter of less than 0.100 inches, said first reed retaining wire means including a first reed first end and a first reed second end;

B. a second reed retaining wire means extending once around the mouthpiece and the adjacently positioned reed at a position spatially disposed longitudinally along the reed from said first reed retaining wire means for retaining of the reed in adjacent abutment to the mouthpiece while allowing musical vibrational movement of the reed, said second reed retaining wire means being of a metallic material, said second reed retaining wire means having a diameter of less than 0.100 inches, said second reed retaining wire means including a second reed first end and a second reed second end;

C. a first drawbar attached to said first reed first end of said first reed retaining wire means and attached to said second reed first end of said second reed retaining wire means to facilitate retaining of the reed in abutment with the mouthpiece while allowing musical vibrational movement thereof;

D. a second drawbar attached to said first reed second end of said first reed retaining wire means and attached to said second reed second end of said second reed retaining wire means to facilitate retaining of the reed in abutment with the mouthpiece while allowing musical vibrational movement thereof; and E. an adjustable clamping means operatively secured to said first drawbar and said second drawbar, said adjustable clamping means adapted to urge said first drawbar and said second drawbar together for tightening of said first reed retaining wire means and said second reed retaining means around the reed into abutment with the mouthpiece while allowing for musical vibrational movement thereof.

2. A wire clamping ligature for use with a single reed mouthpiece for a musical instrument as defined in claim 1 wherein said first reed retaining wire means is of stainless steel wire material.

3. A wire clamping ligature for use with a single reed mouthpiece for a musical instrument as defined in claim 1 wherein said second reed retaining wire means is of a stainless steel wire material.

4. A wire clamping ligature for use with a single reed mouthpiece for a musical instrument as defined in claim 1 wherein said first reed retaining wire means is made of steel wire of approximately 0.030 inches in diameter.

5. A wire clamping ligature for use with a single reed mouthpiece for a musical instrument as defined in claim 1 wherein said second reed retaining wire means is made of steel wire of approximately 0.030 inches in diameter.

6. A wire clamping ligature for use with a single reed mouthpiece for a musical instrument as defined in claim 1 wherein said adjustable clamping means includes:

A. a threaded bore defined within said second drawbar;

B. a clearance bore defined within said first drawbar; and

C. a threaded clamping screw means adapted to extend through said clearance bore to be freely rotatable therein and to, further extend into engagement with said threaded bore to facilitate adjustable clamping between said first drawbar and said second drawbar to facilitate attachment of the reed in abutment with the mouthpiece while allowing for musical vibrational movement thereof.

7. A wire clamping ligature for use with a single reed mouthpiece for a musical instrument as defined in claim 6 wherein said threaded clamping screw means includes a cap thereof to facilitate abutting engagement with respect to said first drawbar adjacent said clearance bore thereof.

8. A wire clamping ligature for use with a single reed mouthpiece for a musical instrument as defined in claim 6 wherein said threaded bore is defined in said second drawbar at a position intermediate between said first reed retaining wire means and said second reed retaining wire means attached with respect thereto.

9. A wire clamping ligature for use with a single reed mouthpiece for a musical instrument as defined in claim 6 wherein said clearance bore is defined in said first drawbar at a position intermediate between said first reed retaining wire means and said second reed retaining wire means attached with respect thereto.

10. A wire clamping ligature for use with a single reed mouthpiece for a musical instrument as defined in claim 6 wherein said threaded clamping screw means includes a thumbscrew tab to facilitate adjustable rotation of said threaded clamping screw means with respect to said first drawbar and said second drawbar.

11. A wire clamping ligature for use with a single reed mouthpiece for a musical instrument as defined in claim 1 wherein said adjustable clamping means includes:

A. a first clearance boss member affixed to said first drawbar adjacent said first reed retaining wire means and defining a first clearance bore extending therethrough;

B. a second clearance boss member affixed to said first drawbar adjacent said second reed retaining wire means and defining a second clearance bore extending therethrough;

C. a first engagement boss member affixed to said second drawbar adjacent said first reed retaining wire means and defining a first threaded bore extending therethrough, said first threaded bore being axially in registration with said first clearance bore;

D. a second engagement boss member affixed to said second drawbar adjacent said second reed retaining wire means and defining a second threaded bore extending therethrough, said second threaded bore being axially in registration with said second clearance bore;

E. a first threaded clamping screw means adapted to extend through said first clearance bore to be freely rotatable therein and to,further extend into engagement with respect to said first threaded bore to facilitate adjustable clamping between said first drawbar and said second drawbar to facilitate attachment of a reed in abutment with a mouthpiece while allowing for musical vibrational movement of the reed; and F. a second threaded clamping screw means adapted to extend through said second clearance bore to be freely rotatable therein,and to further extend into engagement with respect to said second threaded bore to facilitate adjustable clamping between said first drawbar and said second drawbar to facilitate attachment of a reed in abutment with a mouthpiece while allowing for musical vibrational movement of the reed.

12. A wire clamping ligature for use with a single reed mouthpiece for a musical instrument as defined in claim 11 wherein said first threaded clamping screw means includes a first cap thereon to be in abutting engagement with respect to said first drawbar adjacent said first clearance bore defined therein to facilitate urging of said first drawbar and said second drawbar together.

13. A wire clamping ligature for use with a single reed mouthpiece for a musical instrument as defined in claim 11 wherein said second threaded clamping screw means includes a second cap thereon to be in abutting engagement with respect to said first drawbar adjacent said second clearance bore defined there to facilitate urging of said first drawbar and said second drawbar together.

14. A wire clamping ligature for use with a single reed mouthpiece for a musical instrument as defined in claim 11 wherein said first threaded clamping screw means includes a first thumbscrew tab to facilitate adjustable rotation of said first threaded clamping screw means with respect to said first drawbar and said second drawbar.

15. A wire clamping ligature for use with a single reed mouthpiece for a musical instrument as defined in claim 11 wherein said second threaded clamping screw means includes a second thumbscrew tab to facilitate adjustable rotation of said second threaded clamping screw means with respect to said first drawbar and said second drawbar.

16. A wire clamping ligature for use with a single reed mouthpiece for a musical instrument as defined in claim 11 wherein said first clearance boss member and said second clearance boss member are integrally formed with respect to said first drawbar.

17. A wire clamping ligature for use with a single reed mouthpiece for a musical instrument as defined in claim 11 wherein said first engagement boss member and said second engagement boss member are integrally formed with respect to said second drawbar.

18. A wire clamping ligature for use with a single reed mouthpiece for a musical instrument as defined in claim 1 wherein said first drawbar and said second drawbar are made of molded plastic.

19. A wire clamping ligature for use with a single reed mouthpiece for a musical instrument as defined in claim 1 wherein said first drawbar and said second drawbar are made of die cast metal.

20. A wire clamping ligature for use with a single reed mouthpiece for a musical instrument comprising:

A. a first reed retaining wire means of stainless steel wire having a diameter of less than 0.100 inches extending once around a mouthpiece and an adjacently positioned reed for retaining thereof together while allowing musical vibrational movement of the reed, said first reed retaining wire means including a first reed first end and a first reed second end;

B. a second reed retaining wire means of stainless steel wire having a diameter of less than 0.100 inches extending once around the mouthpiece and the adjacently positioned reed at a position spatially disposed longitudinally along the reed from said first reed retaining wire means for retaining of the reed in adjacent abutment to the mouthpiece while allowing musical vibrational movement of the reed, said second reed retaining wire means including a second reed first end and a second reed second end;

C. a first drawbar attached to said first reed first end of said first reed retaining wire means and attached to said second reed first end of said second reed retaining wire means to facilitate retaining of the reed in abutment with the mouthpiece while allowing musical vibrational movement thereof, said first drawbar defining a clearance bore therein at a position intermediate between said first reed retaining wire means and said second reed retaining wire means attached with respect thereto;

D. a second drawbar attached to said first reed second end of said first reed retaining wire means and attached to said second reed second end of said second reed retaining wire means to facilitate retaining of the reed in abutment with the mouthpiece while allowing musical vibrational movement thereof, said second drawbar defining a threaded bore therein in axial alignment with respect to said clearance bore in said first drawbar, said threaded bore being defined in said second drawbar at a position intermediate between said first reed retaining wire means and said second reed retaining wire means attached with respect thereto;

E. an adjustable clamping means operatively secured to said first drawbar and said second drawbar, said adjustable clamping means adapted to urge said first drawbar and said second drawbar together for tightening of said first reed retaining wire means and said second reed retaining means around the reed into abutment with the mouthpiece while allowing for musical vibrational movement thereof, said adjustable clamping means further including a threaded clamping screw means adapted to extend through said clearance bore to be freely rotatable therein and to further extend into engagement with said threaded bore to facilitate adjustable clamping between said first drawbar and said second drawbar to facilitate attachment of the reed in abutment with the mouthpiece while allowing for musical vibrational movement thereof, said adjustable clamping screw means including a cap thereon in abutting engagement with said first drawbar adjacent said clearance bore defined therein to facilitate retainment thereof extending through said clearance bore; and F. a thumbscrew tab means mounted on said threaded clamping screw means to facilitate adjustable rotation thereof with respect to said first drawbar and said second drawbar.

21. A wire clamping ligature for use with a single reed mouthpiece for a musical instrument comprising:

A. a first reed retaining wire means of stainless steel wire having a diameter of less than 0.100 inches extending once around a mouthpiece and an adjacently positioned reed for retaining thereof together while allowing musical vibrational movement of the reed, said first reed retaining wire means including a first reed first end and a first reed second end;

B. a second reed retaining wire means of stainless steel ware having a diameter of less than 0.100 inches extending once around the mouthpiece and the adjacently positioned reed at a position spatially disposed longitudinally along the reed from said first reed retaining wire means for retaining of the reed in adjacent abutment to the mouthpiece while allowing musical vibrational movement of the reed, said second reed retaining wire means including a second reed first end and a second reed second end;

C. a first drawbar attached to said first reed first end of said first reed retaining wire means and attached to said second reed first end of said second reed retaining wire means to facilitate retaining of the reed in abutment with the mouthpiece while allowing musical vibrational movement thereof;

D. a second drawbar attached to said first reed second end of said first reed retaining wire means and attached to said second reed second end of said second reed retaining wire means to facilitate retaining of the reed in abutment with the mouthpiece while allowing musical vibrational movement thereof;

E. an adjustable clamping means operatively secured to said first drawbar and said second drawbar, said adjustable clamping means adapted to urge said first drawbar and said second drawbar together for tightening of said first reed retaining wire means and said second reed retaining means around the reed into abutment with the mouthpiece while allowing for musical vibrational movement thereof, said adjustable clamping means comprising:

(1) a first clearance boss member integrally formed on said first drawbar adjacent said first reed retaining wire means and defining a first clearance bore extending therethrough;

(2) a second clearance boss member integrally formed on said first drawbar adjacent said second reed retaining wire means and defining a second clearance bore extending therethrough;

(3) a first engagement boss member integrally formed on said second drawbar adjacent said first reed retaining wire means and defining a first threaded bore extending therethrough, said first threaded bore being axially in registration with said first clearance bore, (4) a second engagement boss member integrally formed on said second drawbar adjacent said second reed retaining wire means and defining a second threaded bore extending therethrough, said second threaded bore being axially in registration with said second clearance bore;

(5) a first threaded clamping screw means adapted to extend through said first clearance bore to be freely rotatable therein and to further extend into engagement with respect to said first threaded bore to facilitate adjustable clamping between said first drawbar and said second drawbar to facilitate attachment of a reed in abutment with a mouthpiece while allowing for musical vibrational movement of the reed, said first threaded clamping screw means including a first cap thereon to be in abutting engagement with respect to said first drawbar adjacent said first clearance bore defined therein to facilitate urging of said first drawbar and said second drawbar together;

(6) a second threaded clamping screw means adapted to extend through said second clearance bore to be freely rotatable therein and to further extend into engagement with respect to said second threaded bore to facilitate adjustable clamping between said first drawbar and said second drawbar to facilitate attachment of a reed in abutment with a mouthpiece while allowing for musical vibrational movement of the reed, said second threaded clamping screw means including a second cap thereon to be in abutting engagement with respect to said first drawbar adjacent said second clearance bore defined there to facilitate urging of said first drawbar and said second drawbar together;

F. a first thumbscrew tab positioned on said first threaded clamping screw means to facilitate adjustable rotation of said first threaded clamping screw means with respect to said first drawbar and said second drawbar; and G. a second thumbscrew tab positioned on said second threaded clamping screw means to facilitate adjustable rotation of said second threaded clamping screw means with respect to said first drawbar and said second drawbar.

* * * * *